US008469469B2

(12) United States Patent
Kim et al.

(10) Patent No.: US 8,469,469 B2
(45) Date of Patent: Jun. 25, 2013

(54) REFRIGERATOR

(75) Inventors: Jin Ho Kim, Jeollanam-do (KR); Sang Chul Ryu, Gwangju (KR); Young Rak Kim, Gwangju-si (KR); Ji Hoon Kim, Gwangju (KR); Soung Joon Park, Gwangju (KR); Ki Youn Kim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 104 days.

(21) Appl. No.: 12/805,863

(22) Filed: Aug. 20, 2010

(65) Prior Publication Data

US 2011/0048060 A1 Mar. 3, 2011

(30) Foreign Application Priority Data

Aug. 28, 2009 (KR) ..... 10-2009-80320

(51) Int. Cl.
*A47B 96/00* (2006.01)

(52) U.S. Cl.
USPC ..... 312/405; 312/319.5; 312/324; 49/276; 49/277; 49/278

(58) Field of Classification Search
USPC ..... 312/401, 405, 326, 329, 319.5–319.8, 312/324; 62/131; 49/276, 277, 278; 74/412 R, 74/413; 292/DIG. 71, DIG. 72
See application file for complete search history.

(56) References Cited

U.S. PATENT DOCUMENTS

| | | | | |
|---|---|---|---|---|
| 5,397,206 | A * | 3/1995 | Sihon | 411/544 |
| 5,412,839 | A * | 5/1995 | McCollom | 16/430 |
| 5,573,323 | A * | 11/1996 | Kim et al. | 312/405 |
| 5,908,228 | A * | 6/1999 | Lee | 312/405 |
| 6,338,536 | B1 * | 1/2002 | Ueno et al. | 312/405 |
| 6,708,448 | B2 * | 3/2004 | Zappa | 49/41 |
| 6,883,841 | B2 * | 4/2005 | Kawabata et al. | 292/336.3 |
| 7,448,705 | B2 * | 11/2008 | Park | 312/405 |
| 7,496,939 | B2 * | 2/2009 | Guo et al. | 720/664 |
| 7,556,324 | B2 * | 7/2009 | Benz | 312/405 |
| 7,819,488 | B2 * | 10/2010 | Lee et al. | 312/405 |
| 7,992,951 | B2 * | 8/2011 | Kim et al. | 312/405 |
| 8,132,876 | B2 * | 3/2012 | An et al. | 312/405 |
| 2004/0093799 | A1 * | 5/2004 | Yoshikawa et al. | 49/192 |
| 2006/0090400 | A1 * | 5/2006 | Los et al. | 49/28 |
| 2006/0107597 | A1 * | 5/2006 | Jin et al. | 49/149 |
| 2008/0000052 | A1 * | 1/2008 | Hong et al. | 16/382 |
| 2008/0083243 | A1 * | 4/2008 | Lee et al. | 62/446 |
| 2008/0134698 | A1 * | 6/2008 | Cho et al. | 62/127 |
| 2010/0018122 | A1 * | 1/2010 | Hecht et al. | 49/31 |
| 2010/0141107 | A1 * | 6/2010 | Kim et al. | 312/405 |
| 2010/0270900 | A1 * | 10/2010 | Cho et al. | 312/405 |
| 2011/0048060 | A1 * | 3/2011 | Kim et al. | 62/449 |

FOREIGN PATENT DOCUMENTS

| | | |
|---|---|---|
| KR | 10-2007-0041002 | 4/2007 |
| KR | 10-2008-0032587 | 4/2008 |

* cited by examiner

*Primary Examiner* — James O Hansen
*Assistant Examiner* — Daniel Rohrhoff
(74) *Attorney, Agent, or Firm* — Staas & Halsey LLP

(57) ABSTRACT

A refrigerator is disclosed. The refrigerator may have a door opening device which is connected at an external surface of a main body, and includes a pushing unit operated by a driving unit to open a refrigerator door by pushing one side of the refrigerator door. Also, a buffering member may be provided between the door opening device and the external surface of the main body. Accordingly, the reliability of the refrigerator is improved.

17 Claims, 13 Drawing Sheets

REFRIGERATOR

CROSS-REFERENCE TO RELATED APPLICATIONS

This application claims the priority benefit of Korean Patent Application No. 2009-0080320 filed on Aug. 28, 2009 in the Korean Intellectual Property Office, the disclosure of which is incorporated herein by reference.

BACKGROUND

1. Field

Embodiments relate to a refrigerator having a door opening device that automatically opens a refrigerator door.

2. Description of the Related Art

A refrigerator is a device to preserve food freshly at a low temperature by supplying cold air to a storage chamber in which the food is stored. The refrigerator includes a freezing chamber, a temperature of which is kept below the freezing point and a refrigerating chamber, a temperature of which is kept above the freezing point.

Recently, various large refrigerators are being introduced to meet needs for convenience of life and to secure sufficient storage space. Types of the large refrigerators are diversified, for example, into a top mount freezer (TMF) type having the freezing chamber at an upper part, a bottom mount freezer (BMF) type having the freezing chamber at a lower part, and a side by side (SBS) type having the freezing chamber disposed on either of lateral sides.

Since the large refrigerator generally has a large door to open and close a storage chamber, at least a certain degree of power is required to open the door. Therefore, opening the large door may be difficult.

In this regard, a door opening device has recently been developed so as to relieve the difficulty in opening of the door.

Generally, the door opening device is tightly fixed to an external side of a main body of a refrigerator and includes a member operated by a motor to press the door in a direction of opening the door

SUMMARY

Therefore, it is an aspect of embodiments to provide a refrigerator capable of improving reliability by minimizing malfunction of a door opening device thereof.

It is another aspect of embodiments to provide a refrigerator having a lever unit operating the door opening device, improving operability.

In accordance with one aspect of embodiments, there is provided a refrigerator includes a main body having a storage chamber formed therein, a door to open and close the storage chamber, and a door opening device including a housing connected to an external surface of the main body to open the door, and a pushing unit operated by a driving unit installed in the housing, wherein the driving unit is connected with a spark killer to reduce noise generated in a standby mode of the driving unit, and the pushing unit includes a push member moved forward and backward by the driving unit and a photo-interrupter to detect a distance of the forward and backward movement of the push member.

The housing may include a connection hole for connection with the main body, and an elastic grommet may be connected to the connection hole of the housing to maintain an interval between a lower surface of the housing and the main body.

The driving unit may include a motor fastening hole for connection with the housing, and a support member made of an elastic material may be connected to the motor fastening hole to maintain an interval between the driving unit and a lower surface of the housing.

The pushing unit may include a pinion connected to a rotational shaft of the driving unit, an idle gear meshed with the pinion, and a deceleration gear unit meshed with the idle gear to increase a torque of the driving unit.

The refrigerator may further include a switch unit having a switch to operate the driving unit, and a lever unit to operate the switch.

The door may include a switch receiving recess formed on an upper surface thereof to receive the switch unit.

The door may include a handle groove recessed by a predetermined depth from one side surface of the door and extended along the length of the door.

The lever unit may include a lever pivotably connected to one side of the handle groove, and a switch lever connected to the lever to operate the switch unit according to pivoting of the lever.

The refrigerator may further include a mounting frame shaped corresponding to the handle groove and inserted in the handle groove so as to enclose an inner surface of the handle groove.

The refrigerator may further include a hinge groove formed at one side of the mounting frame, and a hinge member rotatably connected in the hinge groove, and the lever may be pivoted in connection with the hinge member.

The lever may further be disposed at an upper part of the door with respect to a longitudinal direction.

The hinge member may be made of resin having excellent abrasion-resistance and friction-resistance.

One end of the switch lever may be connected to one side of the upper end of the lever while the other end inserted in the switch unit may be equipped with an operation unit that operates the switch.

The switch may be a micro switch operating the driving unit by being pushed by the operation unit.

The operation unit may include a magnet, and the switch is a reed switch operated by the magnet.

The switch unit may further include an elastic member to return the magnet to an initial position thereof.

The refrigerator may further include a handle groove recessed by a predetermined depth from one side surface of the door and extended along the length of the door, and a touch pad formed at the handle groove to operate the driving unit.

The touch pad may be enclosed by a rubber member so that malfunction of the touch pad by static electricity is prevented.

In accordance with another aspect of embodiments, there is provided a refrigerator includes a main body having a storage chamber formed therein, a door to open and close the storage chamber, and a door opening device including a pushing unit operated by a driving motor to open the door, wherein the driving motor is connected with a spark killer to reduce noise during a standby mode of the driving motor.

The pushing unit may include a pinion connected to a rotational shaft of the driving motor, an idle gear meshed with the pinion, a deceleration gear unit meshed with the idle gear to increase a torque of the driving motor, and a push member, which is moved forward and backward, to push one side of the door, with a rack gear unit disposed at one side of the push member and meshed with the deceleration gear unit.

The pushing unit may further include a photo-interrupter to detect a distance of the forward and backward movement of the push member.

In accordance with a further aspect of embodiments, there is provided a refrigerator includes a main body having a storage chamber formed therein, a door to open and close the storage chamber, and a door opening device including a pushing unit, which is operated by a driving motor, to open the door, wherein the pushing unit comprises a push member, which is moved forward and backward by the driving motor, to push one side of the door, and a photo-interrupter to detect a distance of the forward and backward movement of the push member.

The refrigerator may further include a spark killer, which is connected to the driving motor, to reduce noise generated during a standby mode of the driving motor.

The pushing unit may further include a pinion connected to a rotational shaft of the driving motor, an idle gear meshed with the pinion, and a deceleration gear unit meshed with the idle gear, wherein the deceleration gear unit may include an output gear unit meshed with a rack gear unit disposed at one side of the push member.

In accordance with a further aspect of embodiments, in a refrigerator including a main body having a storage chamber, a door to open and close the storage chamber, a door opening device including a pushing unit operated by a driving motor to open the door, and a lever unit to operate a switch unit, the lever unit includes a lever pivotably connected to a hinge groove of a handle groove formed at the door.

The lever may be connected to a hinge member made of a lubricating resin material and rotatably connected in the hinge groove.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
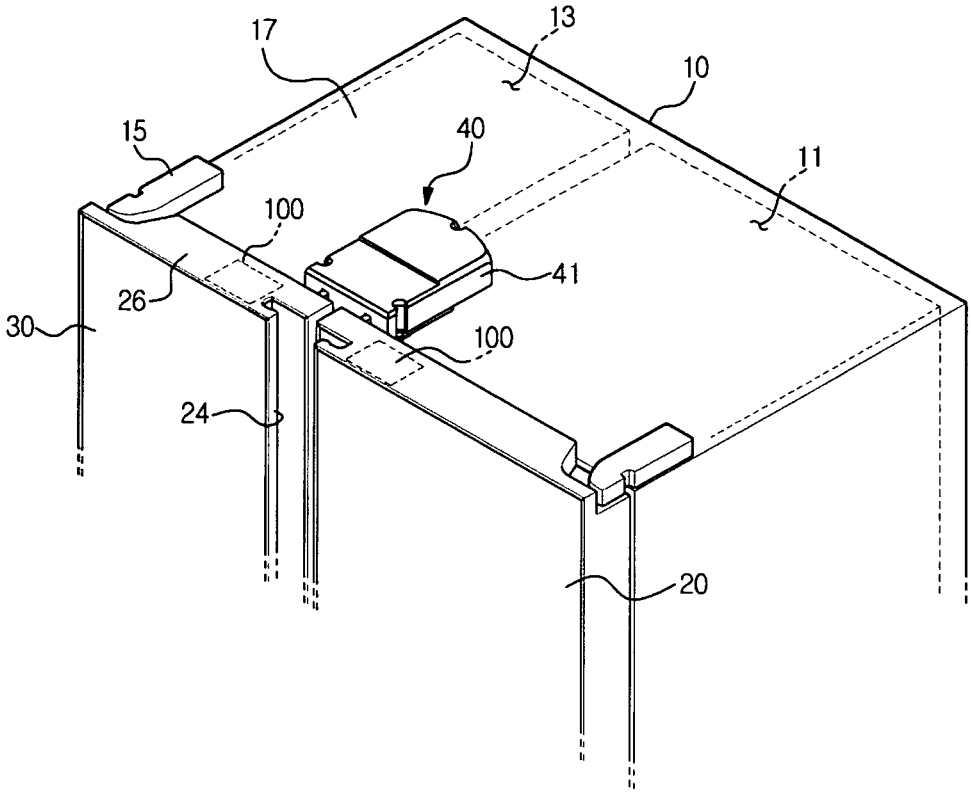
FIG. 1 is a perspective view schematically showing the exterior appearance of a refrigerator according to one embodiment.

Reference will now be made in detail to embodiments, examples of which are illustrated in the accompanying drawings, wherein like reference numerals refer to like elements throughout.

Although a side-by-side (SBS) refrigerator having a freezing chamber and a refrigerating chamber arranged on the left and the right will be described by way of example, embodiments are applicable to any type of refrigerator having a door opening device that opens a refrigerator door.

FIG. 1 is a perspective view of the exterior appearance of a side-by-side (SBS) refrigerator according to an embodiment.

Referring to FIG. 1, the refrigerator includes a main body 10 having storage chambers 11 and 13, doors 20 and 30 hinged upon each opposite side of the main body 10, and a door opening device 40 to open the doors 20 and 30.

The storage chambers 11 and 13 may be divided into a refrigerating chamber 11 and a freezing chamber 13 sectioned into left and right sides by a vertical partition (not shown). The doors 20 and 30 may be a refrigerating chamber door 20 and a freezing chamber door 30 to open and close the refrigerating chamber 11 and the freezing chamber 13, respectively.

One side of each of the doors 20 and 30 is pivotably connected to the main body 10 through a hinge unit 15. A handle unit 24 may be formed at each of the other sides of the doors 20 and 30 for a user to grip when opening and closing the doors 20 and 30.

The door opening device 40 may be disposed at a front part of an upper surface 17 of the main body 10, so as to push one upper side of each of the doors 20 and 30 and thereby open the doors 20 and 30.

The door opening device 40 may be operated by switch units 100 received in one side of each of upper surfaces 26 of the doors 20 and 30. Each switch unit 100 may be operated by a lever unit 200 disposed at a rear surface of each handle unit 24 of the doors 20 and 30.

Figure 2:
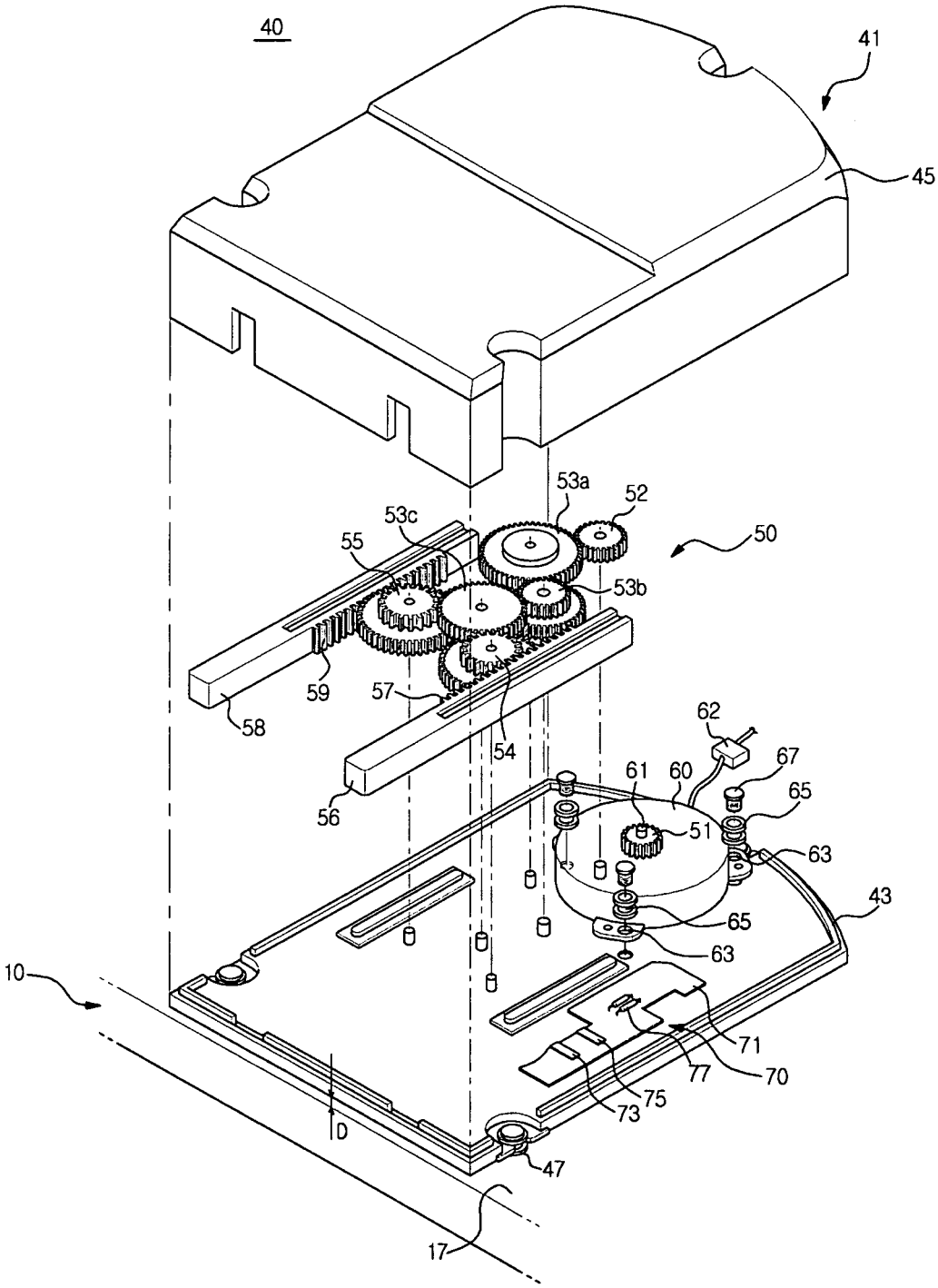
FIG. 2 is an exploded perspective view of a door opening device of the refrigerator shown in FIG. 1.
Figure 3:
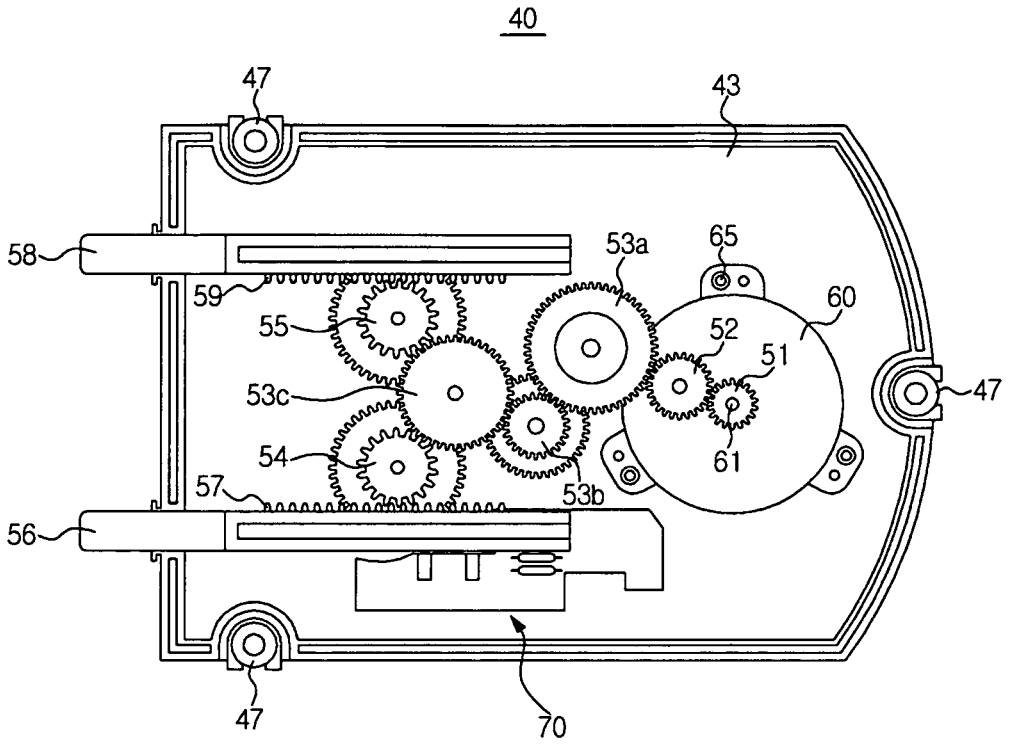
FIG. 3 is a plan view showing the inner structure of the door opening device shown in FIG. 1.
Figure 4A:
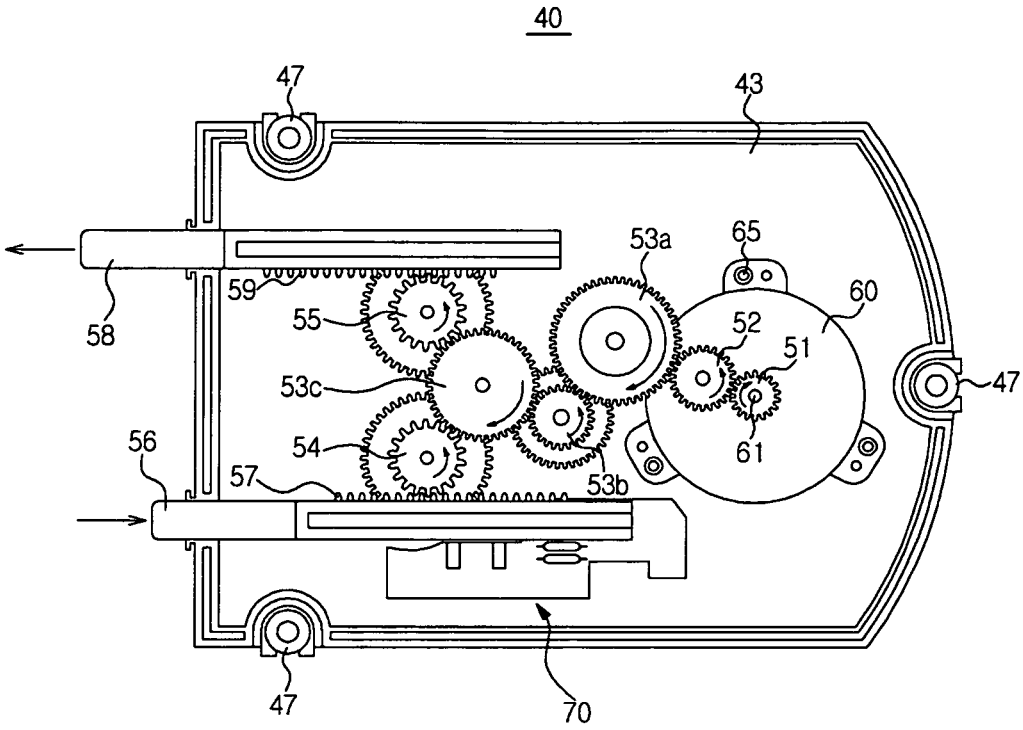
FIG. 4A and FIG. 4B are views showing the operational states of the door opening device shown in FIG. 1.
Figure 4B:
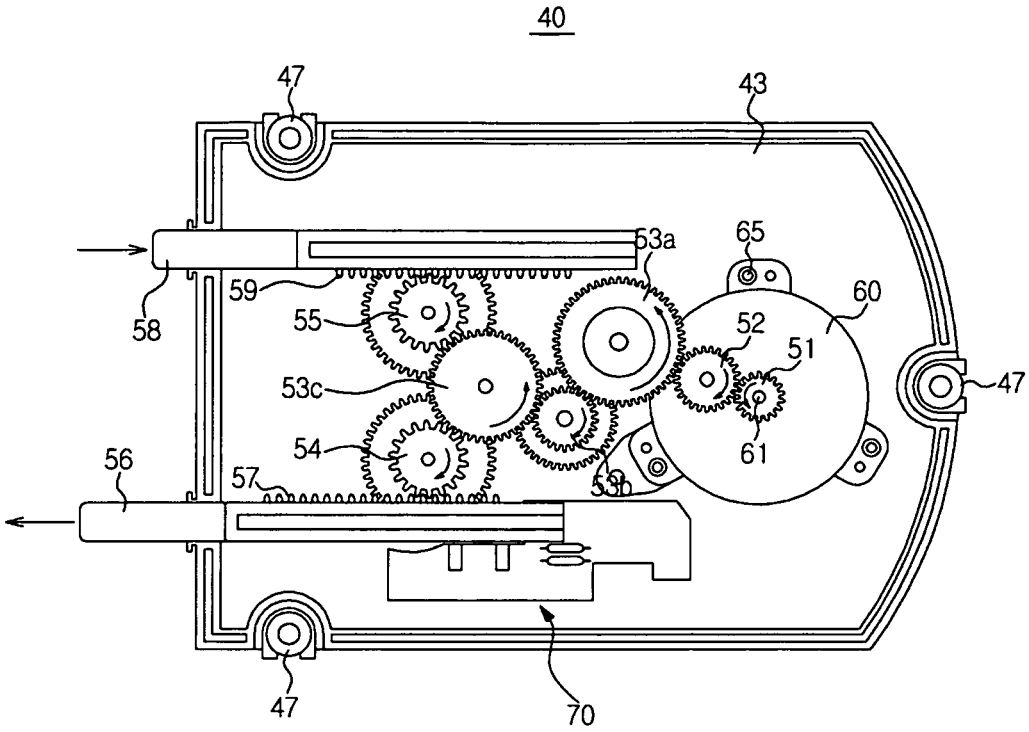

FIG. 2 is an exploded perspective view of a door opening device of the refrigerator according to an embodiment and FIG. 3 is a plan view showing the inner structure of the door opening device according to an embodiment. FIG. 4A and FIG. 4B are views showing the operational states of the door opening device according to an embodiment.

Referring to FIG. 2, the door opening device 40 includes a pushing unit 50 pushing one side of each of the door 20 and 30, a driving unit 60 driving the pushing unit 50, and a housing 41 receiving the pushing unit 50 and the driving unit 60.

The housing 41 may be constituted by a base 43 on which the driving unit 60 and the pushing unit 50 are mounted, and an upper cover 45 covering an upper part of the base 43.

The driving unit 60 may be a driving motor capable of rotating forward and backward.

The driving unit 60 may include a motor fastening hole 63 to be screw-connected with the base 43. The motor fastening hole 63 may be connected with an elastic support member 65 which maintains a predetermined interval between the driving motor 60 and the base 43 while attenuating vibration and noise of the driving motor 60. The elastic support member 65 may be achieved by a general grommet.

The support member 65 may be connected to the base 43 by being press-fitted in the motor fastening hole 63 and fastened by a fixing screw 67.

The pushing unit 50 may include a pinion 51 connected to a motor shaft 61 of the driving motor 60, an idle gear 52 meshed with the pinion 51, and a deceleration gear unit 53*a*, 53*b* and 53*c* meshed with the idle gear 52 to decelerate rotation of the driving motor 60 and thereby increase a torque.

The deceleration gear unit 53*a*, 53*b* and 53*c* further includes output gears 54 and 55 outputting the decelerated rotation of the driving motor 60.

Additionally, the pushing unit 50 further includes push members 56 and 58 pushing the one side of each of the doors 20 and 30, and rack gears 57 and 59 disposed at one side of each of the push members 56 and 58 to be meshed with the output gears 54 and 55, respectively.

According to this structure, the push members 56 and 58 convert rotational motion of the driving motor 60 into linear motion and therefore move forward and backward, thereby pushing the one side of each of the doors 20 and 30.

The push members 56 and 58 may include a first push member 56 to open the refrigerating chamber door 20, and a second push member 58 to open the freezing chamber door 30. The output gears 54 and 55 may include a first output gear 54 meshed with the rack gear 57 of the first push member 56, and a second output gear 55 meshed with the rack gear 59 of the second push member 58.

A sensing device 70 may be provided on a side surface of the first push member 56 to sense a distance of the forward and backward movement of the first push member 56 and accordingly control the operation of the driving motor 60.

The sensing device 70 may include a photo-interrupter which is a non-contact photosensor to accurately measure the distance of the forward and backward movement of the first push member 56.

Specifically, infrared light is emitted from an emission unit 73 formed at a circuit board 71 and is received by a light receiving unit 75 so that a predetermined voltage is output from an amplifier unit 77. The photo-interrupter measures the movement distance of the first push member 56 based on variation of the output voltages.

Accordingly, as shown in FIG. 4A, the door opening device 40 operates in a manner that, when the motor shaft 61 of the driving motor 60 rotates clockwise, the rotation of the motor shaft 61 is transmitted to the deceleration gear unit 53*a*, 53*b* and 53*c* through the pinion 51 and the idle gear 52. Therefore, the rotation of the driving motor 60 is decelerated by the deceleration gear unit 53*a*, 53*b* and 53*c* and is transmitted to the output gears 54 and 55.

Here, the output gears 54 and 55 rotate counterclockwise, thereby moving the first push members 56 and 58, having the rack gears 57 and 59 meshed with the output gears 54 and 55, forward and backward, respectively.

That is, the first push member 56 meshed with the first output gear 54 is moved backward while the second push member 58 meshed with the second output gear 56 is moved forward. As a result, the second push member 58 pushes and opens the refrigerating chamber door 20.

On the other hand, as shown in FIG. 4B, when the motor shaft 61 of the driving motor 60 rotates counterclockwise, the rotation of the driving motor 60 is decelerated by the deceleration gear unit 53*a*, 53*b* and 53*c* including the output gears 54 and 55, thereby moving the first and the second push members 56 and 58 backward.

In this case, the output gears 54 and 56 are rotated counterclockwise and accordingly the first push member 56 meshed with the first output gear 54 is moved forward while the second push member 58 meshed with the second output gear 56 is moved backward.

As a result, the first push member 56 pushes and opens the refrigerating chamber door 20. The first and the second push members 56 and 58 may be returned to their initial positions by a control unit (not shown) after opening the doors 20 and 30.

Figure 5:
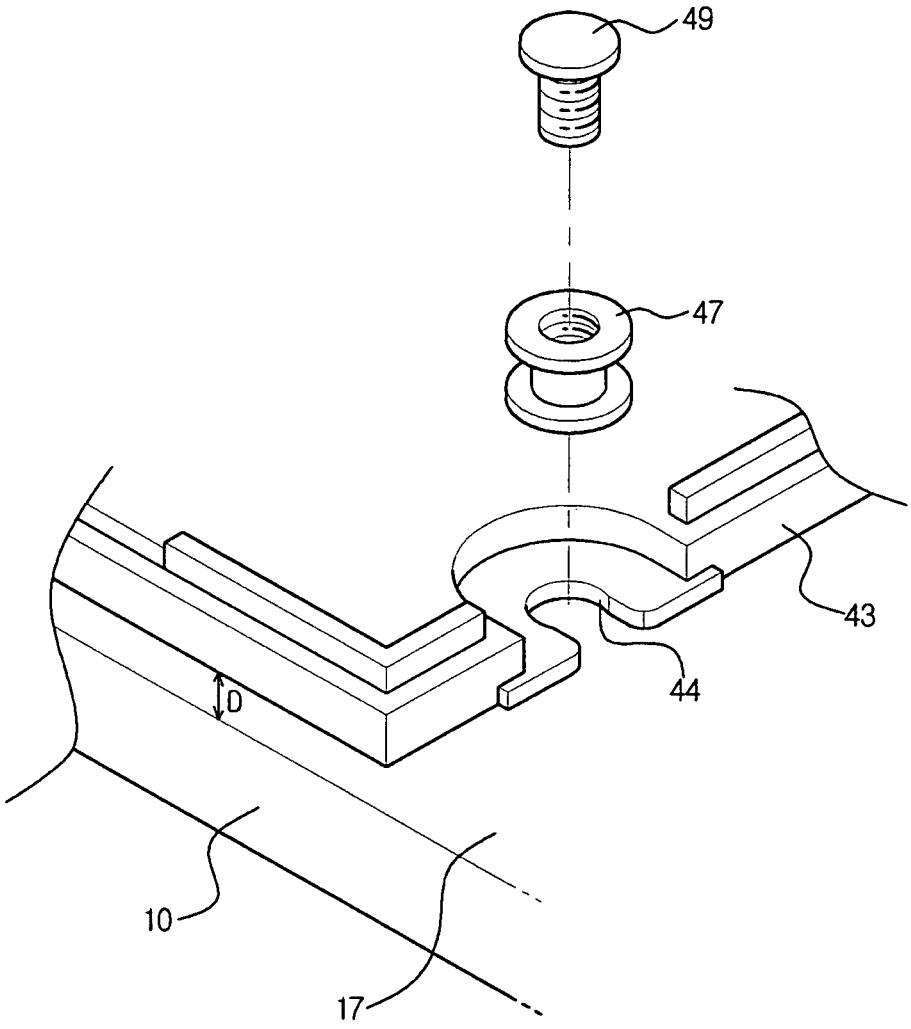
FIG. 5 shows the connection structure of the door opening device shown in FIG. 1.

FIG. 5 shows the connection structure of the door opening device of the refrigerator according to an embodiment, The housing 41 of the door opening device 40 mounted at an external surface of the main body 10 may be disposed in the front middle of the upper surface 17 of the main body 10 as shown in FIG. 2.

If the housing 41 is mounted in close contact with the upper surface 17 of the main body 10, vibration and noise of the driving motor 60 installed in the housing 41 will be directly transmitted to the main body 10. Also, if a foaming agent is injected between an outer cabinet and an inner cabinet of the main body 10, the appearance of the main body 10 may be deformed by barreling of the main body 10 caused by the foaming agent, thereby affecting the installation positions of the pushing unit 50 and the driving motor 60 in the housing 41.

Consequently, the door opening device 40 may cause malfunction. A buffering member 47 may be provided between the upper surface 17 of the main body 10 and the driving motor 60 so as to prevent the malfunction of the door opening device 40.

The buffering member 47 relieves the noise and vibration transmitted between the door opening device 40 and the main body 10, thereby preventing damage of parts mounted in the door opening device 40. Finally, reliability of the door opening device 40 may be improved.

A high-molecular material having a predetermined thickness, such as a rubber pad or polyurethane pad having great elasticity, may function as the buffering member 47, being positioned in an interval D between the main body 10 and the housing 41.

In addition, the buffering member 47 may include an elastic grommet connected to the housing 41 of the door opening device 40 in order to separate the upper surface 17 of the main body 10 from the door opening device 40 by a predetermined interval corresponding to the interval D and, simultaneously, attenuate the vibration and noise.

For this purpose, a plurality of connection holes 44 for screw-connection with the main body 10 are formed at one peripheral side of the base 43 whereon the driving motor 60 and the pushing unit 50 are mounted. A plurality of the buffering members 47 formed of the elastic grommet are inserted in the connection holes 44 and connected with the main body 10 through fastening members 49, such that the door opening device 40 and the upper surface 17 of the main body 10 are spaced apart from each other by the interval D.

Therefore, although a foaming agent is injected in the main body 10 and deforms the appearance of the main body 10 by causing the barreling, the parts mounted in the base 43 are not affected by the deformation. Accordingly, malfunction of the door opening device 40 may be prevented.

In general, the barreling of the main body 10 occupies about 3 mm. Therefore, the interval D of at least 3 mm is exemplarily maintained by the buffering member 47.

In case that a circuit employs a solid state relay (SSR), a sort of electronic relay, to control on and off operations of the driving motor 60, the power supply is not interrupted, achieving prompt signal processing of the driving motor 60. Therefore, residual current is always present at a coil and a core inside the driving motor 60.

As a consequence, the driving motor 70 generates noise due to vibration by the residual current. To this end, a spark killer 62 may be connected to the driving motor 60 as shown in FIG. 2 so as to reduce the noise.

The spark killer 62 greatly improves the responsiveness compared to when using a relay to interrupt the residual current. Furthermore, since the residual current is removed by a resistor and a condenser in the spark killer 62, flow of the residual current into the driving motor 60 is prevented, accordingly considerably reducing the noise generated during a standby mode of the driving motor 60.

As the noise and vibration of the driving motor 60 are thus reduced by the buffering member 47 and the spark killer 62, the reliability of the door opening device 40 may be further improved.

Figure 6:
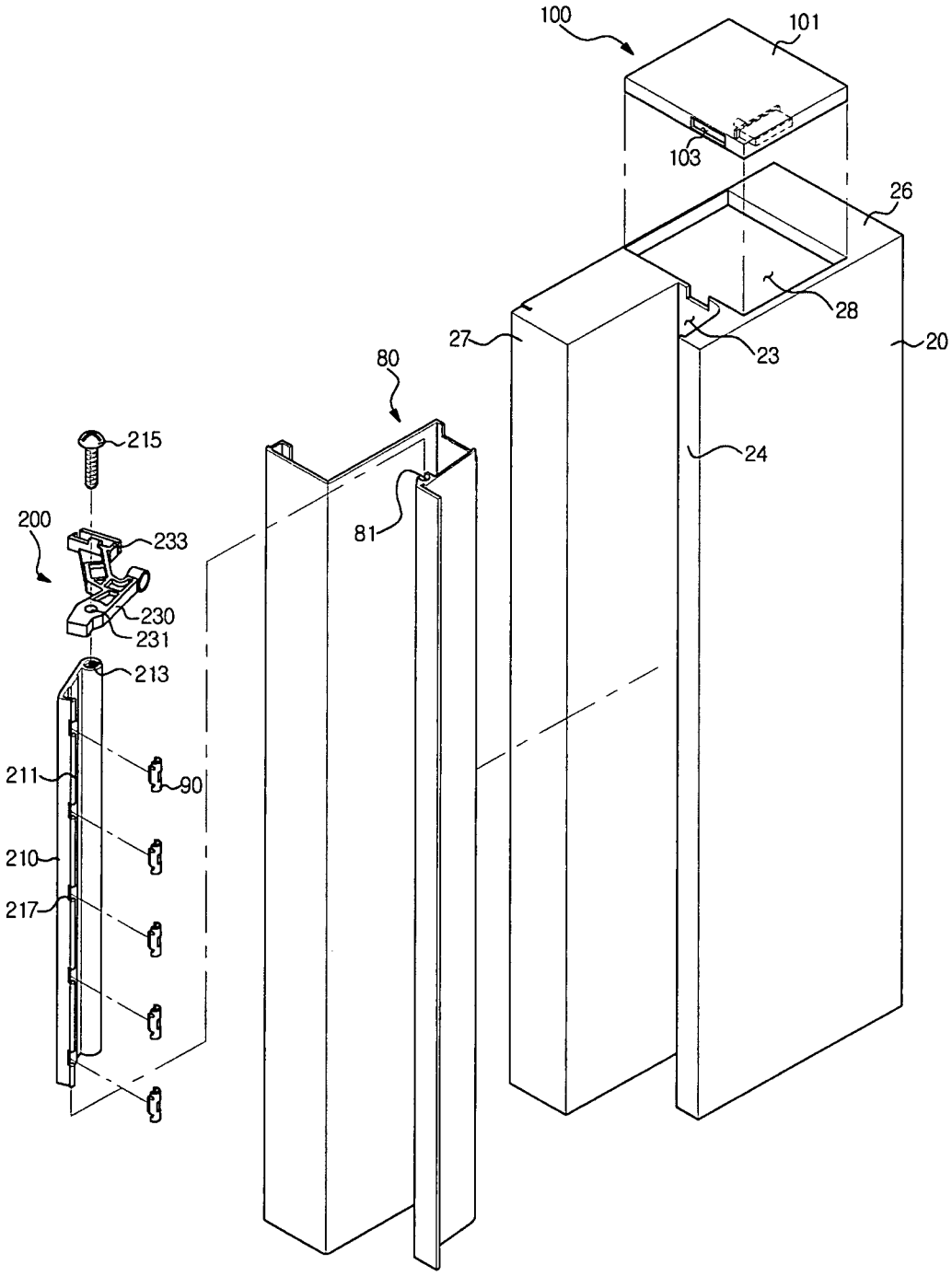
FIG. 6 is an exploded perspective view showing the connection relationship between a lever unit and a switch unit mounted to a door of the refrigerator shown in FIG. 1.
Figure 7:
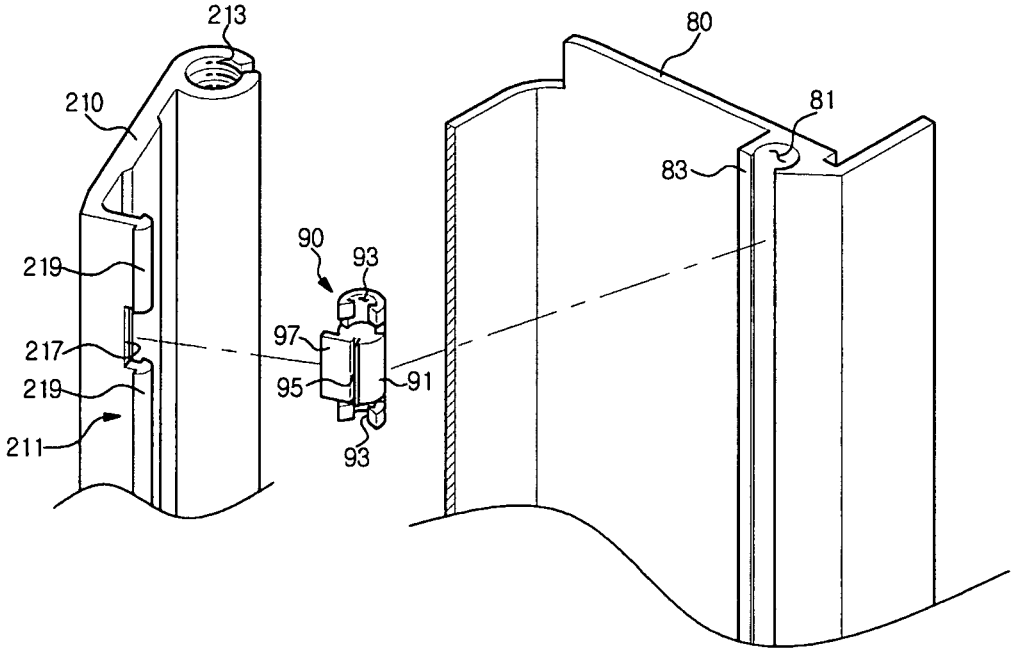
FIG. 7 is a perspective view showing the connection structure of the lever unit.
Figure 8:
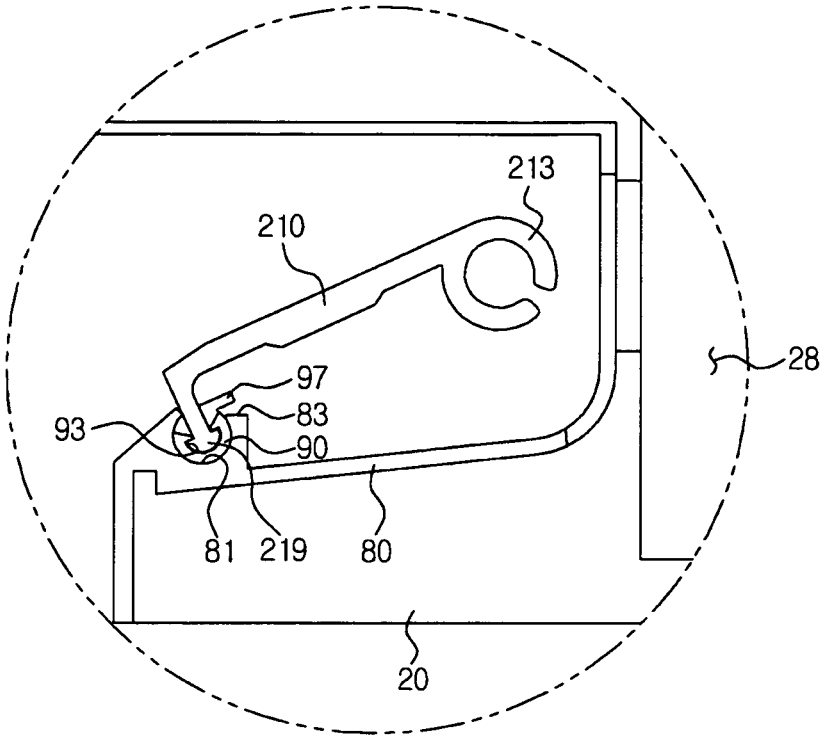
FIG. 8 is a sectional view showing the lever unit in a connected state.

FIG. 6 is an exploded perspective view showing connection relationship between a lever unit and a switch unit mounted to the door of the refrigerator, FIG. 7 is a perspective view showing the connection structure of the lever unit, and FIG. 8 is a sectional view showing the lever unit in a connected state. Since the same structure is applied with respect to both of the doors 20 and 30, the structure and operation of the lever unit and the switch unit will be explained only with regard to the refrigerating chamber door 20.

Referring to FIG. 6, a handle groove 23 may be recessed by a predetermined depth from a side surface 27 of the refrigerating chamber door 20, being extended along the length of the refrigerating chamber door 20.

The handle unit 24 is formed by the existence of the handle groove 23 on the side surface 27 of the refrigerating chamber door 20, to allow the user to grip the handle unit 24 when opening the door 20.

A switch receiving recess 28 may be formed on the upper surface 26 of the refrigerating chamber door 20 to receive the switch unit 100 operating the driving motor 60.

The switch receiving recess 28 has a shape corresponding to the switch housing 101 mounting various switches that will be explained hereinafter, and is disposed adjacent to the handle groove 23.

A lever unit 200 may be provided in the handle groove 23 corresponding to a rear surface of the handle unit 24, so as to operate the switch unit 100 mounted in the switch receiving recess 28.

The lever unit 200 includes a lever 210 pivotably mounted to one side of the handle groove 23, and a switch lever 230 connected to one side of the upper end of the lever 210 to operate the switch unit 100 upon pivoting of the lever 210.

The lever 210 may be formed as a vertically extended rectangular plate. One side of the lever 210 may be formed with a hinge connection part 211 to pivot the lever 210, and the other side of the lever 210 may be formed with a lever connection part 213 to connect the switch lever 230 thereto.

The lever 210 may be made of metal such as aluminum which is easily shaped while having excellent strength.

The lever 210 may be extended from the upper end to the middle part with respect to the length of the door 20 when mounted in the handle groove 23 of the door 20.

In other words, the lever 210 is not formed from the middle part to a lower end of the length of the door 20, so that the door opening device 40 is not unnecessarily operated by a low obstacle such as a child and an object put on the floor.

The lever connection part 213 provided to fix the switch lever 230 may be a screw hole engaged with a fastening member 215 such as a screw or a bolt.

The switch lever 230 is connected to one side of the upper end of the lever 210 to operate the switch unit 100 by being rotated along with the lever 210.

For this purpose, a penetration hole 231 passed through by the fastening member 215 is formed on one side of the switch lever 230 to be connected with the lever connection part 213. In addition, an operation unit 233 is formed on the other side of the switch lever 230 to be inserted in a lever insertion hole 103 formed at the switch unit 100 so as to operate the switches installed in the switch housing 101.

According to an embodiment shown in FIG. 6, the lever 210 and the switch lever 230 are fixed to each other by the fastening member 215 penetrating the penetration hole 231 of the switch lever 230 and screw-connected in the lever connection part 213. However, embodiments are not limited thereto.

For example, a hinge unit (not shown) for connection with the hinge connection part 211 of the lever 210 may be formed on one side in the handle groove 23 so that the hinge connection part 211 of the lever 210 is pivotably connected thereto.

In addition, a mounting frame 80 may be formed to enclose the one side 27 of the door 20 including the handle groove 23, and the hinge connection part 211 of the lever 210 is pivotably connected to the mounting frame 80.

The mounting frame 80 is shaped to enclose the one side 27 of the door 20 including the handle groove 23, and may be in the form of a plate made of metal such as aluminum to prevent scratch or abrasion of an inside of the handle groove 23.

However, when the mounting frame 80 is made of metal, frictional noise may be generated during pivoting of the lever 210 hinged upon the mounting frame 80 while an operation feeling transmitted to the user is deteriorated.

Therefore, the lever 210 may be connected to the mounting frame 80 through a hinge member 90 made of resin having excellent abrasion-resistance and friction-resistance, such as polyacetal or nylon.

Referring to FIG. 7 and FIG. 8, a hinge groove 81 is formed at one side of the mounting frame 80, where the hinge connection part 211 is pivotably connected. The hinge member 90 made of a lubricating material is rotatably mounted in the hinge groove 81. The lever 210 is fixed to the hinge member 90 and rotated according to the rotation of the hinge member 90.

The hinge groove 81 is extended along the length of the mounting frame 80 and has a cylindrical shape, one longitudinal of which side is opened. In addition, a restricting side 83 is protruded along the opened side of the hinge groove 81 so as to restrict a rotation range of the hinge member 90 received in the hinge groove 81.

The hinge member 90 includes a hinge member body 91 having a cylindrical shape inserted and rotated in the hinge groove 81, locking recesses 93 formed at upper and lower ends of the hinge member body 91 to be engaged with the hinge connection part 211 of the lever 210, and an insertion slot 95 formed along one longitudinal side of the hinge member body 91.

In addition, the hinge member 90 further includes a locking part 97 extended from one side of the hinge member body 91 such that rotation of the hinge member body 91 received in the hinge groove 81 is restricted by the restricting side 83 of the mounting frame 80.

Also, a plurality of hinge member mounting recesses 217 are formed at one side of the hinge connection part 211, arranged at predetermined intervals in a longitudinal direction to be connected with a plurality of the hinge members 90. Specifically, the hinge member mounting recesses 217 are inserted in the insertion slots 95 of the hinge members 90.

Furthermore, locking protrusions 219 are protruded from the one side of the hinge connection part 211 and disposed at upper and lower parts of each of the hinge member mounting recesses 217 to be fixedly inserted in the locking recesses 93.

According to the above structure, the lever 210 may be pivotably mounted in the mounting frame 80 through the hinge member 90 made of a lubricating material as shown in FIG. 8.

As described above, the mounting frame 80 made of metal and the lever 210 do not directly contact each other and, accordingly, the noise and the operation feeling of the lever 210 are improved.

Figure 9:
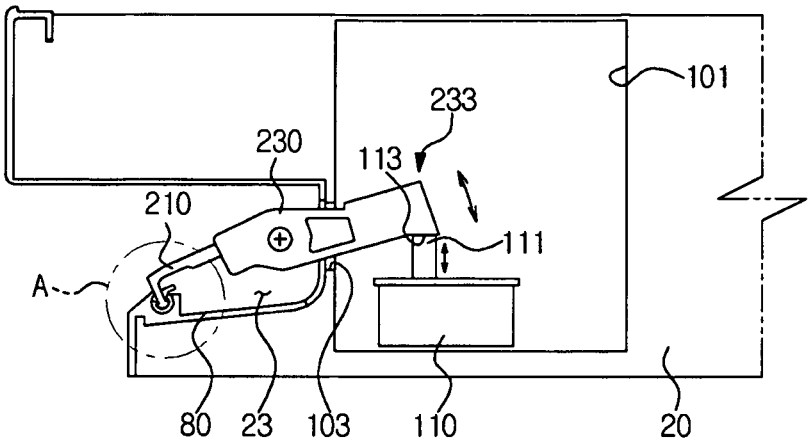
FIG. 9 is a view showing a switch lever and the switch unit of the refrigerator shown in FIG. 1.
Figure 10:
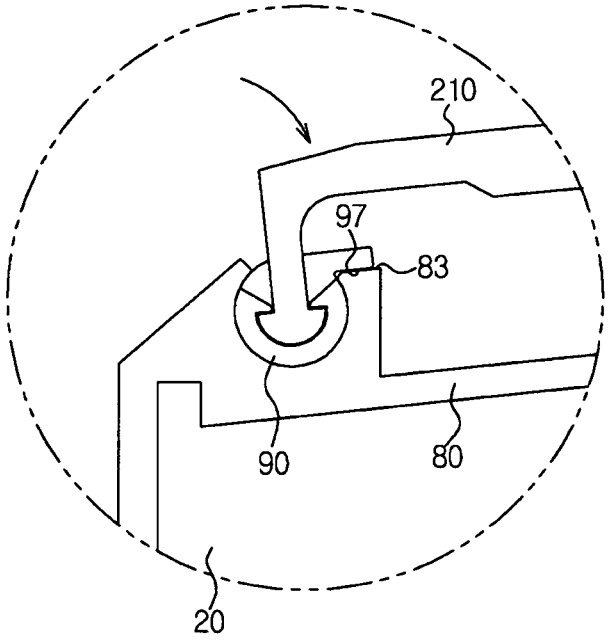
FIG. 10 is an enlarged view of a portion 'A' of FIG. 9.

FIG. 9 is a view showing a switch lever and the switch unit of the refrigerator and FIG. 10 is an enlarged view of a portion 'A' of FIG. 9.

Referring to FIG. 9, the switch unit 100 operating the driving motor 60 of the door opening device 40 may include a micro switch 110.

The switch lever 230 is fixedly connected to one upper side of the lever 210 at one side thereof. The operation unit 233 formed at the other side of the switch lever 230 is inserted into the switch housing 101 through the lever insertion hole 103.

The operation unit 233 may include a pushing surface 113 disposed adjacent to an actuating part 111 of the micro switch 110 formed at one side in the switch housing 101.

More specifically, the micro switch 110 is disposed so that the pushing surface 113 can push the actuating part 111 of the micro switch 110 according to rotation of the switch lever 230.

Accordingly, as a user pivots the lever 210 mounted in the handle groove 23, the switch lever 230 fixed to the lever 210 is rotated along with the lever 210 so that the pushing surface 113 of the switch lever 230 pushes the actuating part 111 of the micro switch 110. Consequently, the driving motor 60 of the door opening device 40 is operated.

Next, when the user releases the lever 210, the force pushing the actuating part 111 of the micro switch 110 is removed. Therefore, the actuating part 111 is returned to its initial position by a recovery spring (not shown) mounted in the micro switch 110, thereby pushing the operation unit 233 of the switch lever 230.

As a result, the lever 210 in connection with the switch lever 230 is also returned to its initial position by the pushing force applied to the switch lever 230.

If the user presses the lever 210 to operate the switch unit 100, rotation of the lever 210 is restricted since the locking part 97 of the hinge member 90 connected to the lever 210 interferes with the restricting side 83 of the mounting frame 80 as shown in FIG. 10.

Accordingly, although the user excessively pivots the lever 210, the operation unit 233 of the switch lever 230 does not push the actuating part 111 of the micro switch 110 by more than a predetermined pressure. Thus, damage of the micro switch 110 may be prevented.

Figure 11:
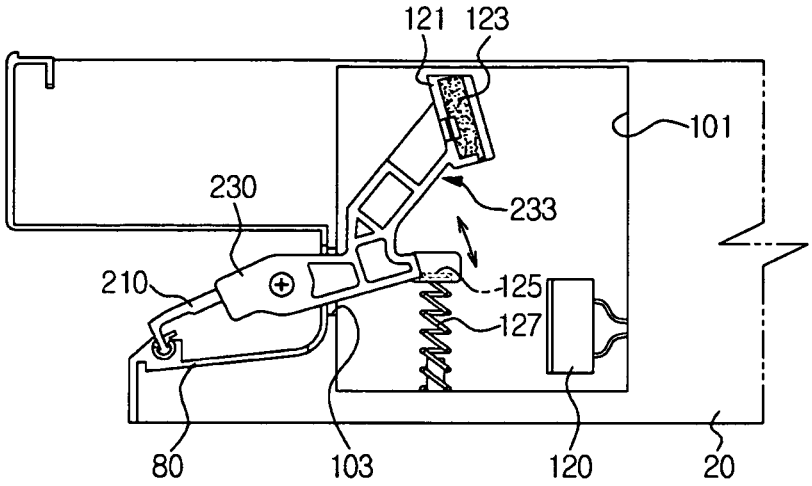
FIG. 11 is a view showing a switch lever and a switch unit of a door opening device according to another embodiment.

FIG. 11 is a view showing a switch lever and a switch unit of a door opening device according to another embodiment.

Referring to FIG. 11, the switch unit 100 operating the driving motor 60 of the door opening device 40 may include a reed switch according to another embodiment.

The reed switch 120 may be disposed at the right lower part of an inside of the switch housing 101.

The switch lever 230 is fixedly connected to one upper side of the lever 210 at one side thereof. The operation unit 233 formed at the other side of the switch lever 230 is inserted into the switch housing 101 through the lever insertion hole 103.

The operation unit 233 includes a magnet mounting part 121 to which a magnet 123 operating the reed switch 120 is mounted, and an elastic member mounting part 125 to which an elastic member 127 returning the operation unit 233 to an initial position thereof is mounted.

The magnet mounting part 121 is disposed to be separated from the reed switch 120 so that magnetic force of the magnet 123 mounted to the magnet mounting part 121 is not applied to the reed switch 120 when the switch lever 230 is not in operation.

The elastic member 127 may be a coil spring, one end of which is fixed to the switch housing 101 and the other end of which is fixed to the elastic member mounting part 125.

When the switch lever 230 is pivoted by the operation of the lever 210, the magnet mounting part 121 of the operation unit 233 is approximated to the reed switch 120, thereby operating the reed switch 120. When the force operating the lever 210 is removed, the operation unit 233 is pushed by the recovery force of the elastic member 127, thereby returning the magnet 123 and the lever 210 to their initial positions.

Figure 12:
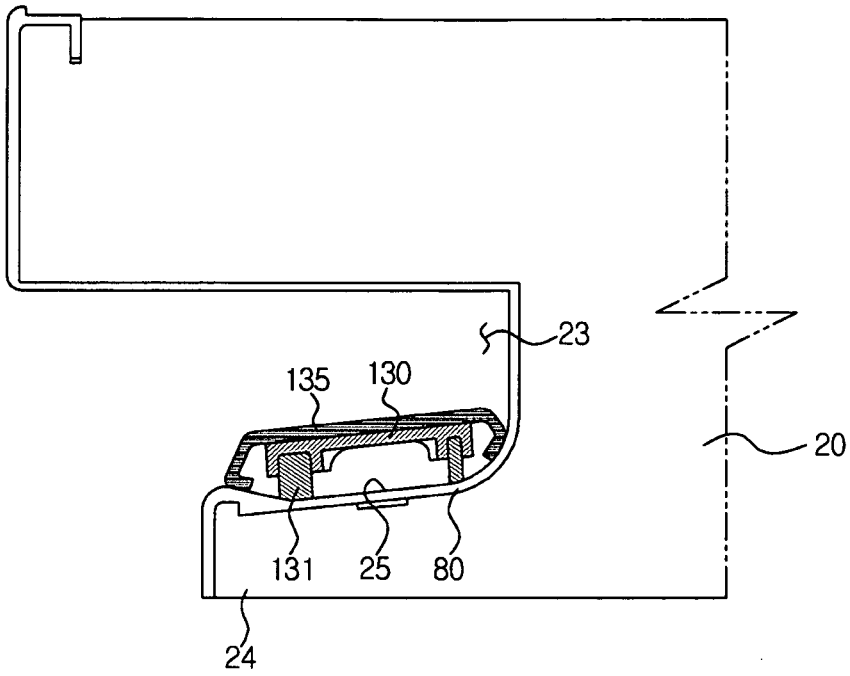
FIG. 12 is a view showing a switch unit operating a door opening device according to a further embodiment.

FIG. 12 shows a switch unit operating a door opening device according to a further embodiment.

Referring to FIG. 12, the switch unit operating the door opening device 40 may include a touch pad 130 disposed on a rear surface 25 of the handle unit 24.

The touch pad 130 may be extended from the upper end to the middle part of the door 20 in a longitudinal direction while being supported by a pad supporting part 131 mounted at the rear surface 25 of the handle unit 24.

In addition, a rubber member 135 may be provided to enclose a rear side of the touch pad 130 so as to prevent malfunction of the touch pad 130 caused by static electricity.

Accordingly, when the user touches the touch pad 130, the driving motor 60 of the door opening device 40 is operated in accordance with signals detected by the touch pad 130. The push members 56 and 58 are moved forward and backward by the operation of the driving motor 60, thereby opening the doors 20 and 30, respectively.

As is apparent from the above description, in a refrigerator according to one or more embodiments, malfunction of a door opening device caused by vibration or barreling of a main body of the refrigerator may be prevented.

In addition, since noise of a driving motor of the door opening device is considerably reduced, the reliability of the refrigerator is improved.

Also, noise generated at a lever unit that operates the door opening device may be reduced while the operation feeling of the lever unit is improved.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body having a storage chamber;

a door to open and close the storage chamber;

a door opening device having a pushing unit to push the door and a driving unit to drive the pushing unit, the door opening device being provided at the main body;

a switch unit having a switch to operate the door opening device, the switch unit being provided at the door; and a lever unit hingedly coupled to the door to operate the switch, wherein the door comprises a handle groove recessed by a predetermined depth from one side surface of the door and extended along the length of the door, wherein the lever unit comprises a lever pivotably connected to one side of the handle groove and a switch lever connected to the lever to operate the switch unit according to pivoting of the lever, and wherein one end of the switch lever is connected to one side of the upper end of the lever while the other end inserted in the switch unit is equipped with an operation unit that operates the switch.

2. The refrigerator according to claim 1, wherein:

the door opening device includes a housing connected to an external surface of the main body including a connection hole for connection with the main body, and an elastic grommet connected to the connection hole of the housing to maintain an interval between a lower surface of the housing and the main body.

3. The refrigerator according to claim 2, wherein:

the driving unit includes a motor fastening hole for connection with the housing, and a support member made of an elastic material is connected to the motor fastening hole to maintain an interval between the driving unit and a lower surface of the housing.

4. The refrigerator according to claim 1, wherein the pushing unit comprises:

a pinion connected to a rotational shaft of the driving unit;

an idle gear meshed with the pinion; and a deceleration gear unit meshed with the idle gear to increase a torque of the driving unit.

5. The refrigerator according to claim 1, wherein the door comprises a switch receiving recess formed on an upper surface thereof to receive the switch unit.

6. The refrigerator according to claim 1, further comprising:

a mounting frame shaped corresponding to the handle groove and inserted in the handle groove so as to enclose an inner surface of the handle groove.

7. The refrigerator according to claim 6, further comprising:

a hinge groove formed at one side of the mounting frame; and a hinge member rotatably connected in the hinge groove, wherein the lever is pivoted in connection with the hinge member.

8. The refrigerator according to claim 7, wherein the lever is disposed at an upper part of the door with respect to a longitudinal direction.

9. The refrigerator according to claim 7, wherein the hinge member is made of resin having abrasion-resistance and friction-resistance.

10. The refrigerator according to claim 1, wherein the switch is a micro switch operating the driving unit by being pushed by the operation unit.

11. The refrigerator according to claim 1, wherein the operation unit includes a magnet, and the switch is a reed switch operated by the magnet.

12. The refrigerator according to claim 1, wherein the switch unit further comprises an elastic member to return the magnet to an initial position thereof.

13. The refrigerator according to claim 1, further comprising:

a touch pad formed at the handle groove to operate the driving unit.

14. The refrigerator according to claim 13, wherein the touch pad is enclosed by a rubber member so that malfunction of the touch pad by static electricity is prevented.

15. A refrigerator comprising:

a main body having a storage chamber formed therein;

a door to open and close the storage chamber;

a door opening device including a pushing unit, which is operated by a driving motor, to open the door;

a switch unit having a switch to operate the door opening device including the driving motor, the switch unit being provided at the door; and a lever unit hingedly coupled to the door to operate the switch, wherein the door comprises a switch receiving recess formed on an upper surface of the door to receive the switch unit, wherein the pushing unit comprises a push member, which is moved forward and backward by the driving motor, to push one side of the door, and a photo-interrupter to detect a distance of the forward and backward movement of the push member, and wherein the photo-interrupter is placed on a side surface of the push member.

16. The refrigerator according to claim 15, further comprising a spark killer, which is connected to the driving motor, to reduce noise generated during a standby mode of the driving motor.

17. The refrigerator according to claim 15, wherein the pushing unit further comprises:

a pinion connected to a rotational shaft of the driving motor;

an idle gear meshed with the pinion; and a deceleration gear unit meshed with the idle gear, and wherein the deceleration gear unit includes an output gear unit meshed with a rack gear unit disposed at one side of the push member.

* * * * *